428-908.8 $$$ SR
PTU24 XR 4,336,937

United States Patent [19]
Kelly

[11] 4,336,937
[45] * Jun. 29, 1982

[54] HARDBOARD-BONDED MELAMINE OVERLAID SURFACE FOR BOWLING LANE

[75] Inventor: Peter B. Kelly, Pasadena, Tex.

[73] Assignee: General Electric Company, Schenectady, N.Y.

[ * ] Notice: The portion of the term of this patent subsequent to Nov. 4, 1997, has been disclaimed.

[21] Appl. No.: 81,216

[22] Filed: Oct. 2, 1979

Related U.S. Application Data

[60] Continuation-in-part of Ser. No. 926,604, Jul. 21, 1978, Pat. No. 4,231,573, which is a division of Ser. No. 901,791, May 1, 1978, abandoned, which is a continuation of Ser. No. 506,069, Sep. 16, 1974, abandoned.

[51] Int. Cl.[3] ..... A63D 1/04; B32B 5/26; B32B 5/30; B32B 21/08

[52] U.S. Cl. ..... 273/51; 156/61; 156/307.4; 156/307.5; 428/204; 428/207; 428/211; 428/528; 428/530; 428/535; 428/537; 428/322.2

[58] Field of Search ..... 428/204, 207, 211, 528, 428/530, 535, 537; 156/61, 309; 273/51

[56] References Cited

U.S. PATENT DOCUMENTS

| | | | |
|---|---|---|---|
| 2,531,168 | 11/1950 | Snyder | 273/51 |
| 2,605,205 | 7/1952 | Patterson et al. . | |
| 2,816,851 | 12/1957 | Arledter . | |
| 3,135,643 | 6/1964 | Michl . | |
| 3,159,526 | 12/1964 | Van Hartesveld et al. | 428/218 |
| 3,185,614 | 5/1965 | Van Hartesveld et al. | 428/218 |
| 3,373,070 | 3/1968 | Fuerst . | |
| 3,373,071 | 3/1968 | Fuerst . | |
| 3,551,272 | 12/1970 | Ash | 428/219 |
| 3,663,341 | 5/1972 | Veneziale | 428/203 |

*Primary Examiner*—James C. Cannon

[57] ABSTRACT

A panel suitable as a bowling lane surface comprising a melamine impregnated protective layer bonded under heat and pressure to a hardboard substrate. The melamine impregnated protective layer is comprised of one or more melamine resin impregnated decorative fibrous print sheets. The surface of the bowling lane so produced is characterized by a falling ball impact resistance of at least 60 inches, a wear rate of between about 0.02 and 0.05 and a Taber abrasion resistance at least about 400 cycles.

2 Claims, No Drawings

HARDBOARD-BONDED MELAMINE OVERLAID SURFACE FOR BOWLING LANE

RELATED APPLICATIONS

This application is a continuation-in-part of my U.S. Patent Application Ser. No. 926,604 filed July 21, 1978, now U.S. Pat. No. 4,231,573, which is a division of my U.S. Patent Applicaton Ser. No. 901,791 filed May 1, 1978, now abandoned, which is a continuation of my U.S. Patent Application Ser. No. 506,069 filed Sept. 16, 1974, now abandoned.

BACKGROUND OF THE INVENTION

1. Field of Invention

This invention relates to new and improved panels for bowling lane structures. More particularly, it relates to new and improved panels which provide bowling lane surfaces.

2. Description of the Prior Art

Standard bowling lanes are often constructed of suitably finished hardwood blocks or planking. In such a lane bed, usually about 41 to 42 inches wide, the construction typically consists of from about 39 to 42 maple planks or boards about one inch thick laid edgewide in line with the longitudinal axis of the lane. The surface of the lane is made flat and coated with varnish or lacquer which is then treated as with mineral oil to reduce wear and adjust the coefficient of friction or slippage of the surface in order to produce uniform action and control of the bowling ball. The surface finish consists typically of a nitrocellulose or polyurethane lacquer which can be treated with plasticizers and other additives to provide with the oil treatment the desired wear and slippage or friction characteristic.

While wooden lanes have been in use for many years, they are subject to a number of deficiencies. For example, present wooden lanes can be easily and severely damaged in the areas of ball release and at the pin deck. Such damage in the ball release area is intensified by lofting of the ball which, upon impact, dents the lacquered and oiled wooden surface. Even normal releases of the ball damage the lane although to a lesser degree. Surface damage in the pin deck area is primarily caused by contact of the struck pins with the surface. Under ordinary circumstances, standard bowling lanes are inspected and often sanded and refinished on an annual basis. Such refinishing is necessary in order to meet set bowling standards and in order to provide uniformity of all lanes so that comparable performance and scoring can be attained insofar as these factors are controlled by the physical condition of the bowling lane itself as opposed to the skill of the bowler.

Materials other than wood have been suggested for use in bowling lanes. For example, U.S. Pat. No. 2,531,168 teaches a top surface layer for bowling alleys formed of laminated plastic compounds such as phenolic, vinyl, acrylic, cellulose acetate, etc. And U.S. Pat. No. 3,014,722 discloses bowling alley lanes formed of sections of laminated fibrous sheet material plies. Other materials have also been disclosed in U.S. Pat. No. 3,670,049 (a moisture curable polyurethane coating composition suitable for finishing bowling lanes); U.S. Pat. No. 3,670,060 (metal bowling alley lanes); U.S. Pat. No. Re. 25,496 (granite as a material for fabricating bowling alley lanes); U.S. Pat. No. 2,679,396 (hard rubber as a bowling alley lane material); and U.S. Pat. No. 2,193,468 (grass like carpet useful in covering a game alley). None of these wood substitutes have proven to be commercially acceptable and wood lanes predominantly remain the materials in common usage today.

U.S. Pat. No. 3,159,526 discloses a finished laminated board with a finished plastic laminate surface wherein the layers of plastic and the wood are joined in a single manufacturing operation and wherein all but one or two of the phenolic resin backing layers are eliminated. The plastic layers are melamine resin impregnated papers. The wood comprises plywood, compressed particle boards or wood shavings boards. U.S. Pat. No. 3,185,614 discloses compressing a mixture of thermosetting plastic and discrete wood particles to form a workpiece, compressing the wood at the surface beyond its elastic limit to form a hardened layer and curing the thermosetting plastic of the workpiece while applying a finishing layer of plastic on the surface and while compressing the layer. An outer layer of thermosetting resin may be pressed on the surface of the board and cured concurrently with the setting of the thermosetting material of the workpiece. And U.S. Pat. No. 3,551,272 discloses the lamination of resin-containing papers, termed "overlay", to forest products such as plywood, particle board, hardboard and the like. The impregnating resin is concentrated in the surface portion of the base sheet material. Aminoplast resins are used such as melamine, substituted melamines, cycloaliphatic guanamines and mixtures thereof.

Japanese application No. SHO-50-111020 laid open for inspection on May 18, 1976 as Publication No. SHO-51-56548, corresponds to U.S. patent application Ser. No. 506,069, filed Sept. 16, 1974, now abandoned, (the disclosure of which was carried forward in U.S. patent application No. 926,604, filed July 21, 1978 [hereinafter the 926,604 application ]) and discloses a high pressure laminate surface suitable for bowling alley lanes. These bowling lane surfaces have been successfully tested in the United States and been welcomed as an advance in the art. See e.g. *Bowling* January, 1977 at page 6.

SUMMARY OF THE INVENTION

1. Objects of the Invention

It will be seen from the above that there is a need for bowling lanes and surfaces, therefore, which are more resistant to physical abuse and wear, have uniformity of surface and which can maintain these qualities over a long period of time.

The bowling lane and surface described in the 926,604 application, assigned to the same assignee as this application, responds, in part, to this need. Therein, there are disclosed particular decorative plastic laminates used to provide improved bowling lanes and surfaces therefor. Each bowling lane comprises a substrate selected from the group consisting of natural wood, consolidated wood fibers, plywood, flakeboard, chipboard and hardboard, and at least one decorative plastic laminate sheet secured to the surface of the substrate. The plastic laminate sheet comprises a plurality of thermosetting resin impregnated core sheets, a melamine resin impregnated decorative fibrous print sheet and an overlying melamine resin containing protective layer. The surface of the bowling lane so produced is characterized by a falling ball impact resistance of at least 60 inches, a coefficient of friction of about 0.18 and a Taber abrasion resistance of at least about 500 cycles.

For resurfacing operations, the laminate of the 926,604 application may be simply glued over existing pine and maple bowling lanes. For new applications, the laminate of 926,604 application may be glued to a suitable substrate such as wood, metal, concrete and the like. As previously indicated herein, the bowling lane and surface disclosed in the 926,604 application has made for a significant advance in the art. The present invention is considered to be a further development of the invention of the 926,604 application and its main features and objectives are thus similar to those of the 926,604 application.

It has been found that a panel may be used to resurface a bowling lane just as effectively as a laminate. The step of making a laminate and then converting to a panel by glueing the laminate to a suitable substrate may be eliminated. Elminating this step not only is economical but provides a panel which is comparable in all respects to the three-stage panel previously disclosed, i.e., the surface-adhesive-core stages panel.

The panel comprises (a) an outer surface stage, a print surface such as paper impregnated with a material which acts as both surface and adhesive and is activated under heat and pressure; and (b) a substrate stage, a hardboard cellulosic type material. The outer surface stage may, for example, comprise low pressure melamine impregnated papers, low pressure polyester impregnated papers or the like. Suitable materials for the substrate stage are tempered and untempered hardboard.

It is, therefore, a primary objective of this invention to provide bowling lanes and surfaces for bowling lanes which comprise a panel composed of melamine or polyester resin impregnated papers bonded to a hardboard substrate.

Another object is to provide a single stage panel suitable for use as a bowling lane.

Still another object is to provide a panel for use as a bowling lane which panel provides an outer surface superior to that of standard wooden lanes.

An object of this invention is to provide a bowling lane having longer wear than wooden lanes.

These and other objects will readily become apparent to those skilled in the art in the light of the teachings hereinafter set forth.

BRIEF SUMMARY OF THE INVENTION

By "one-stage panel" as used herein is meant a printed board.

By "two-stage panel" as used herein is meant a printed paper impregnated with resin pressed to a board.

By "three-stage panel" as used herein is meant a finished decorative surface such as a laminate, a glue line, and a substrate board.

This invention broadly relates to a one-stage panel formed by printing a decorative design (such as a bowling lane pattern) onto a cellulosic substrate, such as hardboard, reinforcing the printed surface and consolidating it to the hardboard substrate with a coating of a plastic or melamine or polyester resin. This invention also relates to a two-stage panel formed when fast cycle low pressure melamine and polyester impregnated papers are pressed to suitable hardboard substrates such as Masonite, Marlite, and the like. According to the present invention, there is provided a two-stage panel having a decorative laminate comprised of melamine or polyester impregnated papers bonded under heat and pressure to a hardboard substrate. Phenolic sheets are optionally present as underlay. In the one-stage panel, a lane design may be printed directly onto the hardboard and overlaid with a clear lacquer, such as butylated melamine.

DESCRIPTION OF THE PREFERRED EMBODIMENTS

It has been found that the separate step of applying an adhesive between the laminate and the substrate in the 926,604 application may be eliminated by pressing melamine and/or polyester resin impregnated papers directly onto hardboard under heat and pressure, with or without one or more phenolic resin impregnated sheets as underlay.

When both opposite outer faces of a hardboard are "printed on" with bowling lane designs, the "one-stage" panel may be installed in a bowling alley as a bowling lane and flipped over when one of the decorative resin surfaces begins to deteriorate to such an extent that play on the lane is affected. The one-stage panel of this invention has a thickness which is limited only by the necessity of withstanding impact without rupturing. However, because of the current construction of bowling lanes, gutters, etc., and the American Bowling Congress specifications for the same, the finished panels are preferably the same thickness as existing wooden lanes. Two-faced, "one-panel" bowling lanes not only provide perfect balance, but also provide minimal warp and two wear surfaces. When one surface is worn to the point where it is no longer aesthetically acceptable, the panel may then simply be reversed to provide a new wear surface. The hardboard substrate of the one-stage panel should be hard and dense enough to withstand in-service impacts of bowling balls and/or pins, and the wear surface of the one-stage panel must be tough enough to withstand the abrasion to which it is subjected by bowlers.

The use of a dense substrate is critical for this invention. The panels should be made with at least 60 pound hardboard as a substrate in order to withstand reasonable impact from a 16 lb. bowling ball. A 45 lb. board has been found to be inadequate. With a 45 lb. board as a substrate, the decorative laminate surface ruptured when impacted with a 16 lb. bowling ball and the board crushed beneath the impact of the ball. The wear rate of the one-stage panel of this invention is between about 0.02 and 0.05.

In addition to the above-mentioned properties, it has been found that the bowling lane surfaces in accordance with the present invention are comparable in other respects to the bowling lane surfaces of the 926,604 application and have a NEMA Standard 8-19-64 falling ball impact resistance of over 60 inches as compared to 32 inches for a typical varnished or lacquered hardwood lane. When a 16 pound standard bowling ball is dropped on the bowling lane of this invention from a height of 3 feet, there is no effect. Both with polyurethane varnish and the nitrocellulose lacquer treated wooden bowling lanes, a deep surface dent resulted from such treatment and the wood fibers of the surface were torn. As measured by the Taber abraser, the NEMA Standard 8-20-1962 abrasion resistance of the lane described in this application is greater than 400 cycles, typically between 450 cycles and 650 cycles, depending on the particular surface, whereas the polyurethane varnish and nitrocellulose lacquer finished lanes have a Taber abrasion resistance of 40 cycles and 25 cycles respectively. The resistance of the surfaces described in the 926,604 application to a burning cigarette in accordance with NEMA Standard 8-19-64 is 300 seconds as opposed to 90 seconds to charring for the polyurethane varnish and 24 seconds to burning with the nitrocellulose lacquer. The slip or coefficient of friction of the surfaces described in the 926,604 application is 0.18 as compared to 0.18 for typical polyurethane varnished layers and 0.16 for typical nitrocellulose lacquer coated lanes, all measurements being taken with an oil-treated surface. The surfaces of the 926,604 application are furthermore resistant to staining by alcohol, detergent, shoe polish, and mustard whereas polyurethane varnished surface lanes are stained by mustard, and nitrocellulose lacquer surface lanes are stained by alcohol, shoe polish and mustard. The 60 degree gloss of the lanes described in the 926,604 application is also comparable to those of present hardwood lanes surfaced with nitrocellulose lacquer.

The bowling lane surfaces or laminates of the present invention are readily made.

The substrate of hardboard cellulosic material is overlaid with a so-called print sheet which imparts the decorative effect as of a wooden grain or other appearance to the laminate. The print sheet can be impregnated as is usual in ordinary decorative laminates. It has been found that a lesser amount than usual of the thermosetting resin impregnant is desirable in the print sheet to toughen the surface of the laminate and make it more impact and fracture resistant in order to resist grooving and denting of the surface. Any of a number of thermosetting resins can be used in the formulation for the impregnant used for impregnating the print sheet where this is indicated including, preferably, a condensation product of melamine and an aldehyde, such materials being characterized by excellent wearing, translucency and resistance to discoloring. A specific material found useful in this connection is a modified melamine formaldehyde reaction product sold by American Cynamid Company under the name of Cymel 428. This resin is a white, free-flowing powder specifically designed for the treatment of paper to be used in decorative laminates. The resin is readily soluble in water or in alcohol-water solvents and gives a clear, colorless solution which is stable at 50 percent by weight solids content for at least two days at room temperature. Typical properties of a 50 percent aqueous solution of this resin at 25° C. include a pH of 8.8 to 9.6, a Gardner viscosity of A to B, a solids content at maximum dilution in water of 26 percent. However, other resins, such polyester resins including unsaturated alkyd-vinyl monomer types, and the like can also be used. Among the melamine resins which can be used are the several more fully described in U.S. Pat. No. 2,605,205.

The paper overlay or protective layer used is normally a highly purified, transparent, alpha cellulose although it can also consist of other transparent or highly translucent cellulosic or synthetic resin fibers such as those of rayon or mixtures of such fibers such as those described in U.S. Pat. No. 2,816,851, among others. This material is impregnated with a self-bonding adhesive containing material such as the melamine resin described previously herein and usually dried to a resin content of from about 33 to 42 percent by weight before consolidation under heat and pressure to the hardboard substrate.

If desired, the abrasion and wear resistance of the paper layer can be increased by incorporating abrasive materials such as finely divided silica, silicon carbide, emery, diamond, tungsten carbide, titanium carbide, boron nitride, aluminum oxide and mixtures of such materials with each other and with other finely divided materials, the wear or abrasion resistance of the overlay being specifically tailored as desired by using materials of the desired hardness. These materials can be uniformly distributed throughout the overlay as by the teaching of U.S. Pat. No. 3,373,070, to give uniform abrasion resistance as the overlay is worn away or they can be concentrated in the surface of the overlay or graded through the thickness of the overlay as desired.

The following examples illustrate the practice of the present invention, it being realized that they are to be taken as exemplary only and not as limiting in any way.

EXAMPLE 1

This example illustrates a bowling lane having a decorative surface incorporating a thermosetting resin containing material for impregnating a paper overlay. There is prepared an overlay of alpha cellulose paper impregnated with a 50 percent water solution of melamine formaldehyde resin, specifically Cymel 428, the impregnated paper being dried to a resin content of 65 percent by weight. There is also prepared in a similar manner a panel layer of 60 pound density hardboard. The panel is prepared by superimposing a melamine impregnated overlay paper as described above onto one 60 pound density hardboard sheet. The panel so laid up is placed between polished stainless steel panels, cured for 15 to 18 minutes at 130° to 135° C. at 1500 psi; the panel then is cooled still under pressure to below 40° C. and removed from the press. Actually, the process is of a time-temperature-pressure nature and can be prepared by curing for from about 20 to 25 minutes at from about 130° C. to 150° C. at pressures ranging from about 1000 psi to about 1500 psi. The resulting panel is 130 mils thick. The finished panel is cured to size.

EXAMPLE 2–5

Following the procedures of example 1, melamine impregnated papers were pressed onto Masonite tempered and untempered hardboards under heat and pressure, with and without two phenolic sheets as underlay. The resulting panels produced were subjected to various tests performed on bowling lanes, all tests being carried out in accordance with NEMA publication LD 1-1964. The results of the tests are set forth in the table hereinbelow:

NATIONAL ELECTRICAL MANUFACTURER'S ASSOCIATION STANDARD TESTS (NAME PUBLICATION NO. LB 1-1964)

| | Tempered Hardboard | | Untempered Hardboard | |
|---|---|---|---|---|
| Test | With Phenolic Underlay Sheets (Example 2) | NO Phenolic Underlay Sheets (Example 3) | With Phenolic Underlay Sheets (Example 4) | NO Phenolic Underlay Sheets (Example 5) |
| Impact, NEMA falling ball | >60 inches | 43 inches | >60 inches | 54 inches |

| | Tempered Hardboard | | Untempered Hardboard | |
|---|---|---|---|---|
| Test | Core (Example 2) | No Core (Example 3) | Core (Example 4) | No Core (Example 5) |
| Impact *16 pound bowling ball | 2–3 feet | 1–2 feet | 2–3 feet | 1–2 feet |

-continued

| NATIONAL ELECTRICAL MANUFACTURER'S ASSOCIATION STANDARD TESTS (NAME PUBLICATION NO. LB 1-1964) | | | | |
|---|---|---|---|---|
| Abrasion Resistance NEMA (Taber) | 425 cycles | 425 cycles | 400 cycles | 375 cycles |
| Wear Rate NEMA | 0.059 | 0.023 | 0.034 | 0.051 |

*Improvised test

From the above it will be seen that the bowling lanes of the present invention surfaced with the present decorative surfacing materials are at least comparable and in many ways superior to present bowling lane or alley surfaces from the point of view of impact and abrasion resistance. At the same time, the present surfaces match or very closely approximate the coefficient of friction of present surfaces so that slippage and control of the ball on the mineral oiled dressed lane is not changed.

What I now claim as new and desire to secure by Letters Patent of the United States is:

1. A bowling lane having a surface characterized by a falling ball impact resistance of at least 60 inches, a coefficient of friction of at least 0.16 and a Taber abrasion resistance of at least about 400 cycles, said bowling lane comprised of a melamine resin impregnated decorative fibrous printed sheet, not more than about 3 phenolic resin impregnated fibrous sheets underlaying said printed sheet, and a cellulosic board of at least 60 pounds density consisting of hardboard bonded to said underlay sheets and said print sheet under heat and pressures from about 1000 psi to about 1500 psi.

2. A bowling lane as defined in claim 1 further including at least one overlying resin containing protective layer of said decorative fibrous print sheet.

* * * * *

4336937 U 119 083
DUBOSE / BOX 711
ACCESSION #58-165
CRYSTAL SQUARE 4 * 105-607
2 STAPLES AT BOTTOM
08150813 ZIP:
08/15 TL
X062